United States Patent [19]

Mullins

[11] Patent Number: 4,665,977

[45] Date of Patent: May 19, 1987

[54] TENSION SET SEAL BORE PACKER

[75] Inventor: Albert A. Mullins, Humble, Tex.

[73] Assignee: Baker Oil Tools, Inc., Orange, Calif.

[21] Appl. No.: 830,954

[22] Filed: Feb. 19, 1986

[51] Int. Cl.[4] ..... E21B 23/06

[52] U.S. Cl. ..... 166/134; 166/139; 166/140

[58] Field of Search ..... 166/134, 138, 139, 140, 166/123, 124, 216, 116, 182

[56] References Cited

U.S. PATENT DOCUMENTS

| | | | |
|---|---|---|---|
| 3,283,821 | 11/1966 | Brown | 166/134 |
| 3,385,366 | 5/1968 | Elliston | 166/134 |
| 4,078,606 | 3/1978 | Montgomery | 166/138 |
| 4,289,200 | 9/1981 | Fisher, Jr. | 166/182 |
| 4,296,806 | 10/1981 | Taylor et al. | 166/139 |
| 4,565,247 | 1/1986 | Tapp et al. | 166/123 |

*Primary Examiner*—James A. Leppink
*Assistant Examiner*—Hoang C. Dang
*Attorney, Agent, or Firm*—Norvell & Associates

[57] ABSTRACT

A seal bore packer comprising a packer subassembly which can be employed with either wireline or tubing manipulatable packer setting subassemblies is disclosed. Packing elements and slips on a packer subassembly are expanded when relative axial forces are applied to the packer by wireline or mechanical setting forces. The packer has an inner mandrel and intermediate mandrel connected by a shear pin. A collapsible ring holds the outer packer assembly, including slips and packing elements, normally secured to the intermediate mandrel. Relative movement between the intermediate mandrel and the inner mandrel releases the packer.

12 Claims, 8 Drawing Figures

TENSION SET SEAL BORE PACKER

BACKGROUND OF THE INVENTION

1. Field of the Invention

This invention relates to well packer apparatus for use in sealing the annulus between an outer conduit such as a casing and an inner conduit such as a tubing string in a subterranean well, especially a well used for the production of oil or gas.

2. Description of the Prior Art

Conventional packers used to seal the annulus between a tubing string and the casing in a subterranean oil or gas well can either be permanent packers or retrievable packers. Retrievable packers are intended to be lowered into the well bore and set at some desired downhole location to isolate the annular areas above and below the packer and between the inner and outer conduit during certain downhole operations. Retrievable packers, like permanent packers, employ a sealing or packing element to form the annular seal engaging both the casing and sealing along the exterior of the tubing string. Although not essential for simpler packers, more complex packers also employ means to anchor the packer in engagement with the well casing. Conventionally, radially expandable anchoring slips having an exterior surface suitable for gripping the well casing are employed with more complex retrievable packers. Depending upon the conditions to be encountered in the subsurface well, packers may employ anchoring slips capable of holding the packer in place against only upwardly directed forces. Conversely, packers may employ anchoring slips capable of holding the packer in place against downwardly directed forces. However, in all but the simpler applications, packers must be anchored against forces acting in opposite directions. In many conventional retrievable packers, anchoring slips are expanded radially outwardly by oppositely facing expanders or cones or wedges which are axially shiftable to engage the lower surface of the anchoring slips. In conventional packers, means have been provided for expanding the packing element simultaneously with the expansion of the anchoring slips or expanding the packing before or after actuation of the anchoring slips.

Conventional retrievable packers and similar downhole tools can be actuated by fluid pressure, by wireline, or by manipulation of the tubing string. Hydraulic or hydrostatic retrievable packers are commonly used in deviated wells where tubing manipulation cannot be reliably transmitted to the packer apparatus. Either rotational or longitudinal manipulation has been employed to set retrievable packer. Some retrievable packers have employed a combination of rotational and longitudinal manipulation or longitudinal force applied through the tubing string to set a packer. For example, the retrievable packer disclosed in U.S. Pat. No. 3,507,327 employs rotational manipulation and compressive force or set-down weight to maintain the packer in a set configuration. Other conventional packers, such as the model "AD-1" tension set packer shown on page 845 of the 1982–83 composite catalog of *Oil Field Equipment and Services* published by World Oil, are set in response to a tensile force applied through the tubing.

In addition to merely manipulating the packers between a retracted and an expanded set configuration, longitudinal forces or stresses applied to the packer can be significant in maintaining an adequate seal over the life of the packer. Extrusion of the packing element can result in a loss of the longitudinal compressive stress necessary to maintain proper squeeze on the packing elements and a proper wedging action to maintain the anchoring slips in expanded configuration. Therefore, it is desirable either to maintain a continuous axial force or stress on the packing element and slip assembly or to provide means for intermittently applying longitudinal stress to the packer assembly. In actual oil field operations, it is often simpler to apply a tensile force to the packing element, since adequate compressive forces may be difficult to apply.

While numerous packers having one or a portion of capabilities of the tension capabilities of the tension set neutral packer disclosed in this application is known, none has all of the capabilities of the device disclosed herein, which includes the use of the same packer subassembly with separate wireline and tubing manipulatable packer setting subassemblies.

DETAILED DESCRIPTION OF THE PREFERRED EMBODIMENTS

Figure 2A:
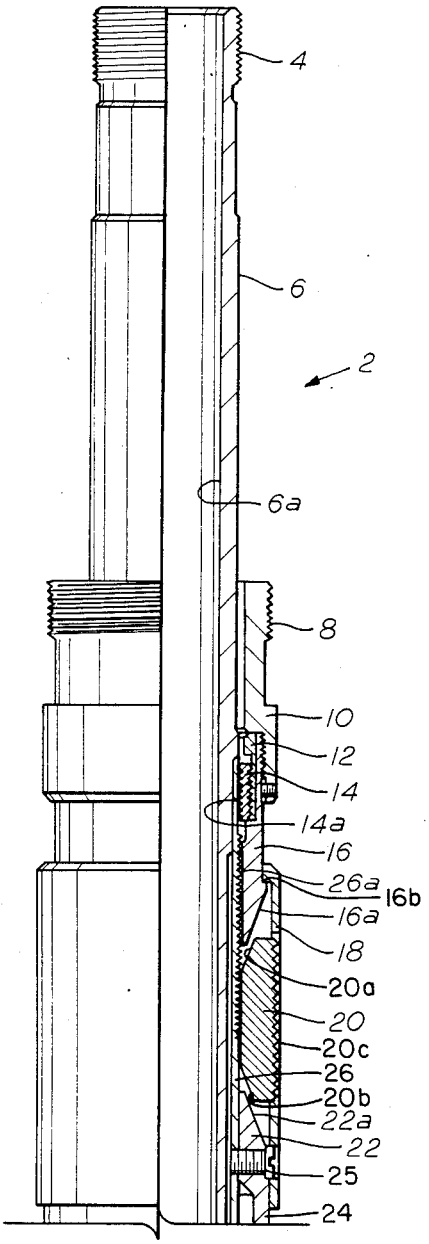
FIGS. 2A and 2B are longitudinal continuations of a packer subassembly containing anchoring slips and a packing element.
Figure 2B:
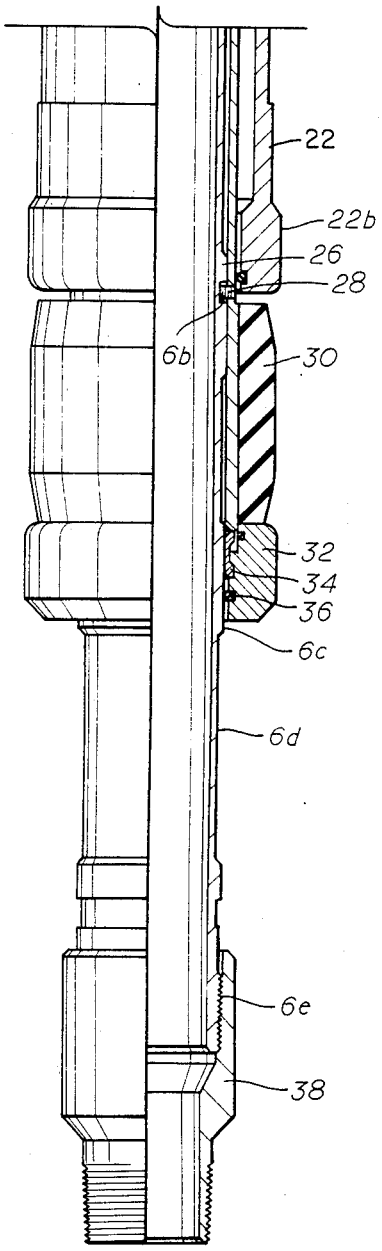
Figure 3:
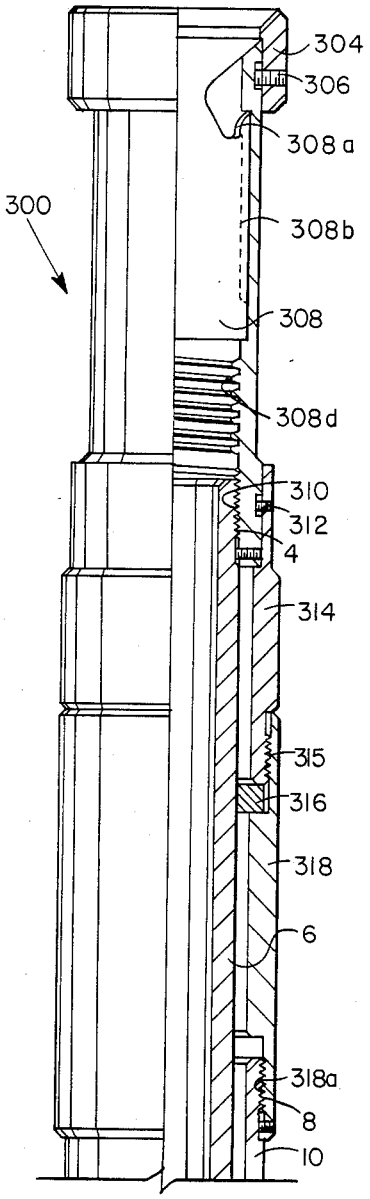
FIG. 3 is a view of a wireline setting subassembly which can be attached to the packer subassembly shown in FIGS. 2A and 2B.
Figure 4:
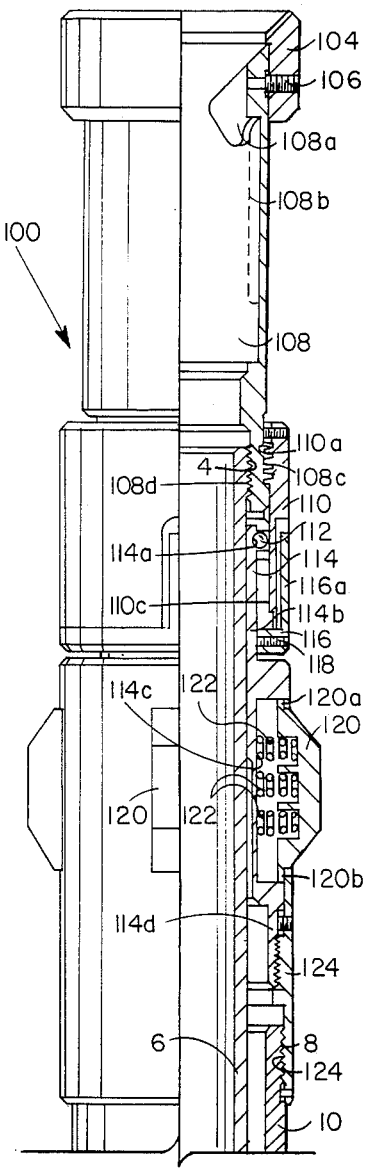
FIG. 4 is a tubing manipulatable setting subassembly which can be attached to the packer subassembly shown in FIGS. 2A and 2B in the manner shown in FIGS. 1A–1D.

The packer apparatus disclosed herein comprises a packer subassembly 2 which can be alternatively attached to one of two packer setting subassemblies 100 or 300, shown in FIGS. 3 and 4. The basic packer subassembly is shown in FIGS. 2A and 2B and comprises means containing radially expandable anchoring slips 20 and at least one axially extending, annular packing element 30. The packer subassembly has a longitudinally extending inner mandrel 6 having conventional threads 4 located at its upper end for connection to a setting tool. Mandrel 6 comprises a tubular member having a honed or smooth seal bore surface **6*a* extending substantially along the entire interior of the mandrel. An exterior crossover sub 10 is located intermediate the ends of the mandrel 6 and comprises the uppermost element of the outer housing of the packer subassembly 2. Threads 8 are located on the exterior surface of the crossover sub housing 10 at its upper end for connection to a setting tool, as will be described. Crossover housing sub 10 is in turn attached by a conventional threaded connection to an upper expander cone 16 having a downward and outwardly facing inclined conical surface 16*a*** extending therearound.

A lock ring retaining sleeve 12 is located in abutting relationship to crossover sub 10 and the upper expander cone 16 on the interior of the expander cone. Lock ring retainer 12 engages a first ratcheting locking member 14, which comprises a resilient cylindrical C-ring member having oppositely facing threads on the interior and the exterior. The resilient locking ring 14 is held in place by engagement of the lock ring retaining sleeve 12 with both the expander cone 16 and the upper housing crossover sub 10. Although the interior threads 14*a* on the lock ring 14 are in contact with that portion of the mandrel 6 extending through the resilient ring 14, the teeth 14*a* do not engage cooperating teeth on this exterior portion of the inner mandrel 6.

An intermediate mandrel 26 extending circumferentially around the inner mandrel 6 over a portion of the length thereof has its upper end intermediate the ends of the inner mandrel 6, initially in the vicinity of the resilient locking ring 14. Ratcheting threads 26*a* extend along the upper portion of the intermediate mandrel 26 from a position below the releaseable latch or locking ring 14 for a portion of the length of the intermediate mandrel 26.

The upper expander cone 16 is positioned in surrounding relationship to the resilient locking ring 14 and initially extends around a portion of the ratcheting threads 26*a*. The cone 16 engages an exterior slip cage 18 by means of cooperating shoulder 16*b*. Slip cage 18 has a plurality of radially extending openings, each for receiving a radially expandable anchoring slip 20 having upper and lower beveled surfaces 20*a* and 20*b* initially opposing the downwardly facing conical expander surface 16*a* and the lower conical expander surface 22*a* adjacent the lower end of the anchoring slips 20. The anchoring slips 20 have an outer serrated surface 20*c* suitable for securely engaging an exterior tubular conduit or casing in a subterranean well.

A lower expander member 22 having an upwardly facing inclined conical expander surface 22*a* opposed to the lower end of the anchoring slips 20 is located immediately below the anchoring slips. A torque pin 25 extending through the lower expander 22 engages both the intermediate mandrel 26 and the exterior slip cage 24, thus preventing movement of the packer setting subassembly rotationally relative to the anchored slips 20.

An enlarged abutting ring portion 22*b* is located at the lower end of the lower expander cone 22. Abutting ring 22*b* is in turn located immediately above the packing element 30 shown in the retracted configuration in FIG. 2B. The packing element 30 comprises an annular member, and, in the preferred embodiment, an elastomeric resilient material is used to fabricate the packing element 30. Packing element 30 can comprise any one of a number of different generally conventional packing elements or packing element assemblies suitable for axial contraction and radial expansion to establish a seal between an inner conduit, such as a tubing string, and an outer conduit, such as the casing, in a subterranean oil or gas well. A lower abutment ring 32 is located adjacent the lower end of packing element 30 and comprises a member having substantially the same diameter as upper abutting ring section 22*b*.

The intermediate mandrel 26 is secured to the inner mandrel 6 by means of a pin 28 which comprises a frangible or disengageable member having a prescribed shear strength. The pin 28 is received within a circular cavity 6*b* extending radially partially through the inner mandrel 6. Disengageable shear member 28 retains the intermediate mandrel 26 axially fixed relative to the inner mandrel 6 so long as the disengageable shearable pin 28 remains intact.

A raised surface 6*c* located on the exterior of the inner mandrel 6 below cavity 6*b* extends radially beyond those portions of the inner mandrel 6 above and below surface 6*c*. Most importantly, surface 6*c* extends radially beyond the recess surface 6*d* on the exterior of the mandrel located immediately below the raised surface 6*c*. Raised surface 6*c* engages an inwardly biased resilient ring 34 located in engagement with the lower end of the intermediate mandrel 26 and the lower abutting ring 32. When the inwardly biased ring 34 is located along raised surface 6*c*, ring 34 is maintained in engagement with both the intermediate mandrel 26 and the lower abutment ring 32 by the inner mandrel 6 which is axially fixed relative to both the intermediate mandrel 26 and the lower abutment ring, so long as pin 28 remains intact.

If the packer subassembly 2 is to be incorporated into a tubular string extending both above and below the packer subassembly, means must be provided at the lower end for attaching the inner mandrel 6 to the tubing extending therebelow. In the embodiment of FIG. 2, threads 6*e* located at the lowermost end of inner mandrel 6 are shown engaging cooperating threads on a crossover sub 38. Crossover sub 38 is adapted to be engaged into a portion of the tubing string extending therebelow or into a separate downhole tool attachable below the packer.

The packer subassembly 2 shown in FIGS. 2A and 2B is shown in the retracted position with the anchoring slips 20 and the packing element 30 in their radially innermost position. In order to set the packing element 30 and the anchoring slips 20, these elements must be radially expanded into engagement with the outer casing in a subterranean well. The packer subassembly alone is not capable of expanding the anchoring slips or the packing element 30 without the use of an appropriate setting subsassembly. Means must be provided to apply an axially directed force to inner mandrel 6 to cause the inner mandrel 6, the intermediate mandrel 26, the lower abutting ring 32 and the lower expander cone 22 to shift upwardly relative to the upper expander cone 16. Conversely, means must also be provided for imparting relative movement between the upper expander cone and the remaining portions of the packer subassembly which are axially shiftable relative thereto. In the preferred embodiment of this invention, tension is applied to the inner mandrel 6 to shift the inner mandrel and those portions of the packer subassembly 2 located below the upper cone 16 upwardly into engagement with the upper cone.

The packer setting subassembly 2 shown in FIGS. 2A and 2B is especially adapted to be selectively attached to setting subassemblies for setting the packer subassembly in response to manipulation of a wireline string or manipulation of the tubing string extending above the packer setting sub assembly 2. Separate setting subassemblies suitable for use with packer subassembly 2 are shown in FIGS. 3 and 4. FIG. 3 discloses a wireline actuating setting subassembly. FIG. 4 shows a setting subassembly for actuating packer subassembly 2 by manipulating the tubing. In FIGS. 3 and 4, the mandrel 6 and the crossover member 10 on the packer subassembly shown in FIG. 2A are shown to indicate the manner in which the packer subassembly is attached to each packer setting subassembly.

The wireline setting subassembly shown in FIG. 3 can be employed with a conventional wireline apparatus to radially expand the anchoring slips 20 and the packing element 30 of the packer subassembly. Wireline setting subassembly 300 comprises an upper cylindrical portion 308 having a cylindrical collar 304 secured thereto by means of a pin 306. A J-slot is defined on the interior of the upper cylindrical section 308 and is defined by an upper portion 308*a* extending partially around the circumference of the inner bore of the cylindrical member 308 and a longitudinal portion 308*b* extending therebelow. Square threads 308*d* are located intermediate the ends of the cylindrical section 308. The square threads 308*d* are of the type suited for engagement with a conventional wireline apparatus. Interior threads 310 located adjacent the lower end of cylindrical section 308 comprise mating threads for engaging the threads 4 located at the upper end of the inner mandrel 6 on the packer subassembly 2 shown in FIGS. 2A and 2B.

A second cylindrical subassembly comprising cylindrical members 314 and 318 secured by a conventional intermediate threaded connection 315 is shear pinned to the exterior of the lower end of cylindrical section 308 by pin 312. The upper end of cylindrical section 314 has an inner diameter sufficient to be received in surrounding relationship on the lower end of the upper cylindrical section 308. Shear pin 312 extends through the upper portion of cylindrical segment 314 into a recess on the exterior of cylindrical section 308. Although only one shear pin 312 is shown in FIG. 3, a plurality of similar shear pins could be located around the periphery of cylindrical section 314. Threads 318*a* located at the lower end of cylindrical section 318 are dimensioned to engage the threads 8 located at the upper end of crossover section 10 on the packer subassembly 2 shown in FIGS. 2A and 2B.

When the wireline setting subassembly shown in FIG. 3 is secured to the packer setting subassembly 2*a*, the upper cylindrical section 308 will be secured to the inner mandrel 6. The outer section consisting of cylindrical segments 314 and 318 will be secured to the upper cone 16 through the crossover member 10. A cylindrical bearing ring 316 located on the interior of cylindrical sections 314 and 318 and extending inwardly from the inner bore of cylindrical sections 314 and 318 is dimensioned to engage the outer surface of the inner mandrel 6 on the packer setting subassembly between the threads 4 and a position adjacent threads 8. The bearing ring 316 serves to prevent buckling of either the inner mandrel 6 or of the outer cylindrical section consisting of segments 314 and 318 when compressive loads are applied during setting of the anchoring slips 20 and the packing elements 30.

Figure 1A:
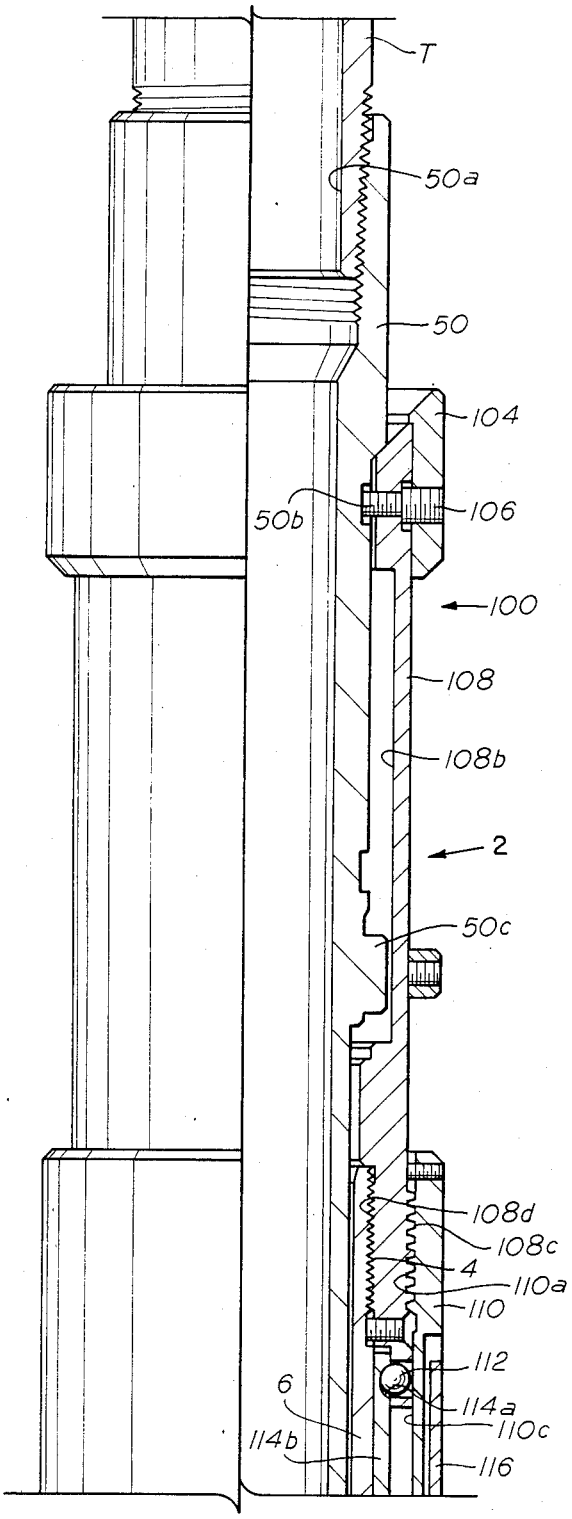
FIGS. 1A, 1B, 1C, and 1D are longitudinal continuations of a seal bore well packer actuated by manipulation of a tubing string.
Figure 1B:
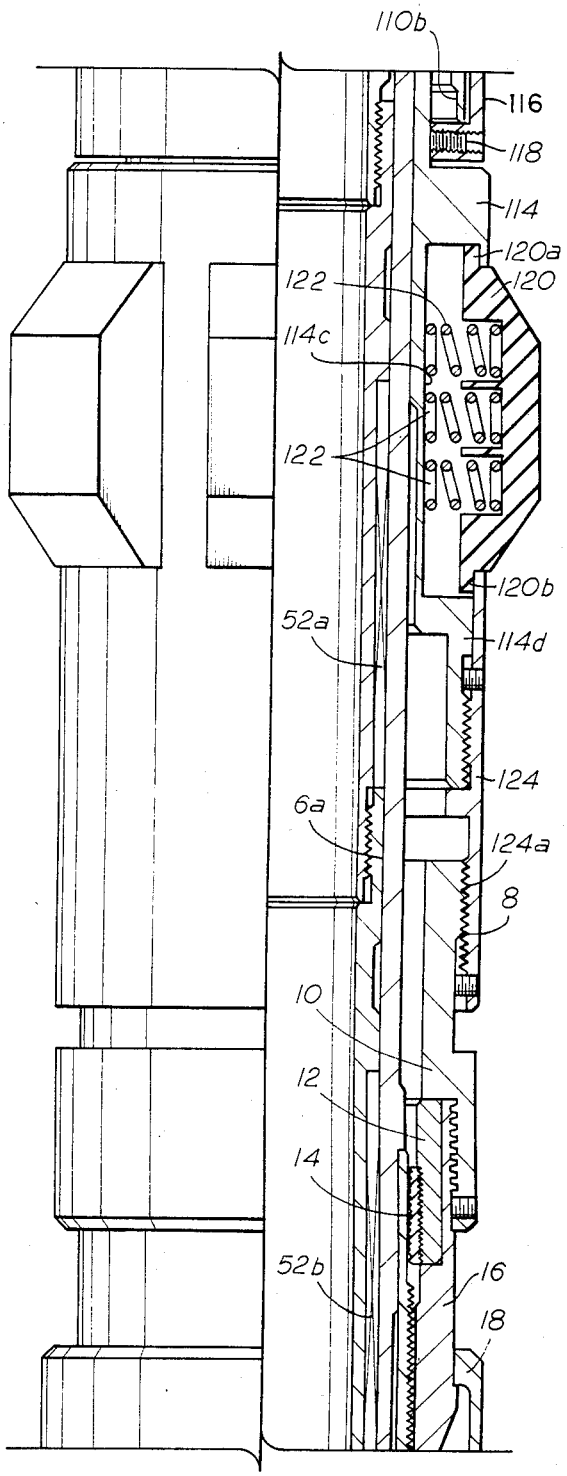
Figure 1C:
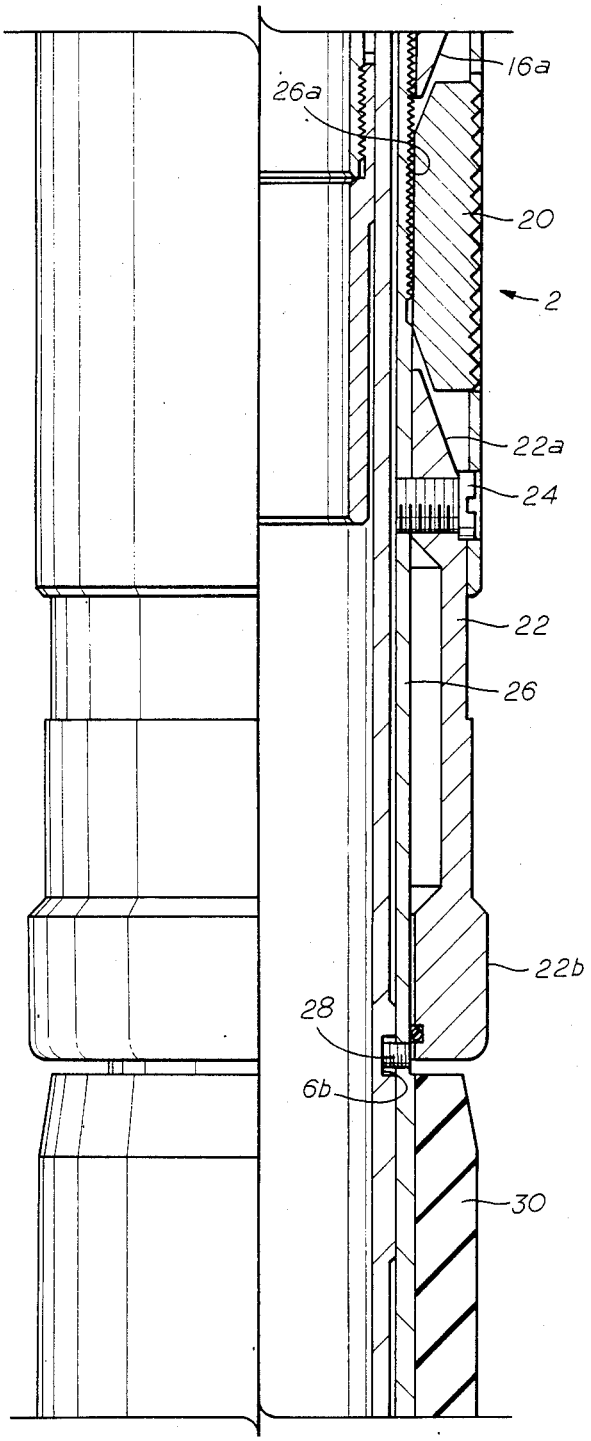
Figure 1D:
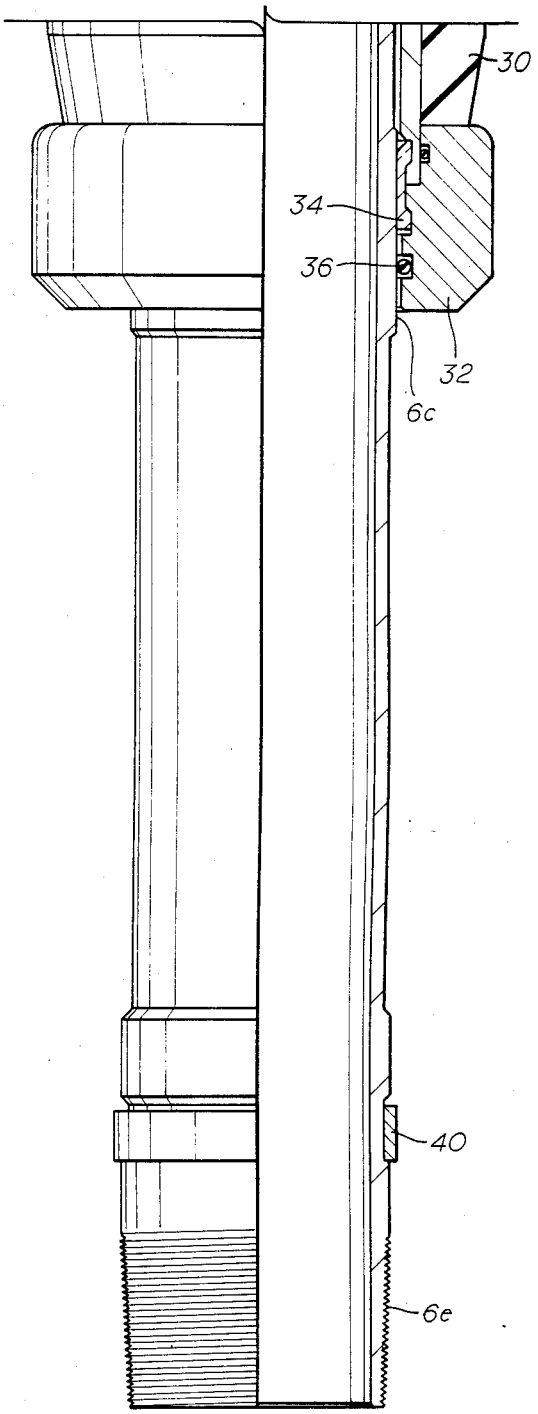

A mechanical setting subassembly 100 is shown in FIG. 4 for use with a packer subassembly 2 to expand the anchoring slips 20 and the packing element 30 in response to manipulation of the tubing extending thereabove. The mechanical setting subassembly is shown attached to the packer subassembly 2 in FIGS. 1A, 1B, 1C and 1D. Mechanical setting subassembly comprises an upper cylindrical member 108 secured to a cylindrical collar 104 at its upper end by a pin 106. A J-slot consisting of an upper J portion 108*a* and a longitudinally extending J portion 108*b* is defined on the interior of cylindrical segment 108 (FIG. 4). This J-slot is formed in the same manner as the the J-slot in section 308 of the wireline setting subassembly 300. Cylindrical section 108 has threads 108*d* located on the interior adjacent the lower end thereof. Threads 108*d* are dimensioned for engagement with threads 4 on mandrel 6 of packer subassembly 2 as shown in FIG. 1A. Precisely machined threads 108*c* are located on the exterior of section 108 adjacent the lower end thereof. A nut member 110 having threads 110*a* engageable with threads 108*c* is positioned on the exterior of the lower end of cylindrical section 108.

Nut member 110 has an inner cylindrical surface 110*c* defining its inner periphery below the threads 110*a*. An interfitting key member 116 has an axially extending portion 116*a* extending around only a portion of the circumference of the assembly and adapted to be received within a groove located on the exterior of nut member 110. Extension 116*a* engages the companion groove on nut member 110 along a length at least equal to the travel of threads 108*c* and 110*a* such that key member 116 remains in engagement with nut member 110 so long as threads 108*c* remain engaged to threads 110*a*. Key member 116 is secured on the exterior of a drag block housing 114 by means of a set screw 118 engaging the exterior of the drag block housing 114. Key 116 thus remains fixed relative to the drag block housing 114. Drag block housing 114 has an upwardly extending section encircled by key 116 and by the lower surface 110*c* of nut 110. A ball groove 114*a* located on the exterior upper end of drag block housing 114 is dimensioned to receive a spherical locking ball 112 when the ball 112 is in engagement with the inner surface 110*c* of the nut member. Nut member 110 engages ball 112 to maintain the ball in groove 114*a*, thus maintaining the ball fixed relative to the drag block 114. Of course a plurality of balls 112 could be used at various circumferential locations around the periphery of drag block housing 114 each held within its companion groove by the inner surface 110*c* of the nut member 110.

Drag block housing 114 has an exterior circumferential cavity 114*c* for receiving a plurality of drag blocks 120 each spring loaded relative to the drag block housing by a plurality of coil springs 122. Lips 120*a* and 120*b* on each drag block engage companion lips on the drag block housing to limit the outward movement of drag blocks 120. A lower sub 124 is attached to the lower end of drag block housing 114 and has interior threads 124*a* located at its lower end. Threads 124*a* are dimensioned for engagement with threads 8 on the packer subassembly 2. The upper section 108 of mechanical setting subassembly 100 can thus be attached to the inner mandrel 6 by interengagement of threads 108*d* with threads 4. The drag block assembly consisting of drag block housing 114 and drag blocks 120 can be attached to the upper cone 16 of packer subassembly 2 by engagement between threads 124*a* and 8. Thus mechanical manipulation can be transmitted to the mandrel 6 while the slip cone is maintained in a stationary position by frictional engagement between drag blocks 120 and the casing of an oil or gas well. Of course mechanical manipulation of the mandrel 4 relative to the upper cone 16 can only occur after disengagement between threads 110*a* and 108*c* as discussed hereafter.

FIGS. 1A, 1B, 1C and 1D show the mechanical setting subassembly 100 attached to the packer subassembly 2 to form a mechanically manipulated packer. The packer shown in FIGS. 1A–1D is in retracted configuration prior to expansion of anchoring slips and packing element 30. Of course it will be understood that a similar packer assembly can be fabricated using the same packer subassembly 2 secured to the wireline setting subassembly 300.

FIGS. 1A, 1B, 1C and 1D also illustrate the use of an inner seal assembly or stinger 50 which can be employed to maintain sealing integrity with the inner seal bore surface 6*a* on mandrel 6 during reciprocation of the tubing attached to the seal assembly 50. Packer setting subassembly 2 thus comprises a seal bore packer subassembly. The tubular seal assembly or stinger 50 can be secured to a conventional tubing string T by means of threads 50*a* located at the upper end thereof. To prevent inadvertent disengagement of the J-slot configuration between the tubing seal assembly 50 and the setting head of the packer, the stinger 50 is shear pinned by means of pin 50*b* to the cylindrical section 108 of the mechanical setting subassembly 100. The seal assembly 50 can similarly be shear pinned to the upper cylindrical section 308 of the wireline setting subassembly 300.

An outwardly extending J-pin 50*c* is located on the exterior of the seal assembly or stinger 50. J-pin 50*c* is received within the J-slot 108*b* defined on the inner surface of cylindrical section 108 and can be disengaged first by shearing pin 50*b* and then shifting the J-pin 50*c* longitudinally and rotationally to free the pin 50*c* from the slot thus permitting reciprocation of the stinger 50 and tubing T relative to the seal bore of the packer. A plurality of conventional seals 52*a* and 52*b* are located on the exterior of the tubing seal assembly or stinger 50. These seals 52*a* are suitable for maintaining sealing integrity with the seal bore surface 6*a* during reciprocation of the stinger 50 relative to the seal bore packer.

OPERATION

Operation of the seal bore packer comprising packer subassembly 2 will be described first with reference to the mechanical or tubing set version of the apparatus described in FIGS. 1A, 1B, 1C, and 1D. Thereafter, the operation of the wireline set embodiment will be described. As the packer apparatus 2 is run into a well attached to the mechanical setting subassembly 100, the anchoring slips 20 and packing element 30 are in the retracted position. The packer assembly, including the packer subassembly 2 and the setting subassembly 100, is attached to the stinger or tubing seal assembly 50 which is in turn attached to the tubing string T. The drag blocks 120 being outwardly spring biased are in a position to engage the wall of the casing during insertion of the assembly into the well. Frictional engagement between drag blocks 120 and the casing will retard both longitudinal and rotational movement of the packer assembly. When the packer is positioned adjacent a desired position within the well, the tubing T can then be manipulated to set the packer by applying a force through the setting subassembly 100. For the mechanical set version, the anchoring slips 20 and packing element 30 cannot be expanded until the threaded connection 110*a*, 108*c* is disengaged. Thus inadvertent rotation of the packer during insertion would not serve to either release the tubing seal assembly from the J-slot configuration or to inadvertently set the packer. The threads 108*c* and 110*a* are disengaged by rotating the tubing T through a prescribed number of complete turns in order to disengage these threads. Rotation of the tubing T will be transmitted through the seal assembly 50 to the upper cylindrical member 108. The nut 110 does not rotate relative to the member 108. Key 116, which is attached to the drag block housing 114 by screw 118, prevents rotation of nut 110 during rotation of the tubing. So long as the threads 108*c* and 110*a* are in engagement, the locking ball 112 prevents movement of the cylindrical assembly 108 upward relative to the drag block assembly and to upper cone 16 by a distance sufficient to initiate setting of the packer. Nut 110 is, however, moveable longitudinally relative to the drag block assembly during rotation of the tubing T. Upward movement of nut 110 relative to cylindrical member and relative to threads 108*c* will disengage threads 110*a* from threads 108*c* and will also shift surface 110*c* upwardly by a sufficient amount to release locking ball 112 from its companion groove 114*a* thus permitting relative movement between cylindrical section 108 and the drag block housing 114. Thus, nut 110 and ball 112 function as a releasable connection.

Since the drag block housing 114 is attached to the upper cone 16, the inner mandrel 6 can then be shifted longitudinally relative to upper cone 16 upon the application of an axial force through tubing T. This upward force will be transmitted through the mandrel 6 and through frangible pin 28 to the intermediate mandrel 26. Intermediate mandrel 26 is in turn attached to lower abutting ring 32 by the collapsible ring 34 held in its expanded position by the raised surface 6*c* on the inner mandrel. The tensile force applied to the inner mandrel 6 is thus transmitted through the lower abutment ring 32 and the packing element 30 to the lower expander cone 22. Continued upward movement will shift the inclined surface 22*a* of the lower expander cone 22 beneath the expandable anchoring slips 20. Continued upward movement of lower expander 22 will also cause upward movement of the slips 20 before complete expansion of the anchoring slips into engagement with the casing. Sufficient tensile force may be applied to the lower expander member 22 to fully expand the anchoring slips 20 and wedge the anchoring slip 20 into engagement with the casing and into engagement with surfaces 16*a* and 22*a* on the upper and lower expander member 16 and 22. With the slips thus in engagement and the packer firmly anchored to the casing, continued upward force will cause expansion of the packing element 30 as the lower abutment ring 32 moves relative to the upper abutting ring portion 22*b*. Upon expansion of the packing element 30 into engagement with the casing, sealing integrity is established in the annulus. With the packer thus set, the tubing seal assembly or stinger 50 can be disengaged from the mechanical setting subassembly 100 by shearing pin 50*b* and by rotating J-pin 50*c* out of the J-slot defined on the inner surface of member 108. The tubing and the tubing seal assembly 50 are thus free to telescope relative to the inner seal bore surface 6*a* of inner mandrel 6. Sealing integrity is maintained by seals 52*a* and 52*b* during longitudinal movement of the seal assembly 50.

When it is necessary to release the packer assembly, the J-pin 50*c* is shifted back into engagement with the J-slot on the inner surface of cylindrical section 108. Upward force applied to the tubing string through the seal assembly to sleeve 108 of the mechanical setting head is transferred to the inner mandrel 6. Upon exertion of an upward force on inner mandrel 6 greater than the force necessary to set the packer, the frangible pin 28 will be sheared thus permitting longitudinal movement between the inner mandrel 6 and the intermediate mandrel 26. Upward movement of the inner mandrel 6 by a prescribed amount relative to intermediate mandrel 26 will move surface 6*c* from beneath the inwardly collapsible ring 34. Since the surface 6*c* is formed on a relatively thicker portion of the inner mandrel than the recessed portion 6*d*, the inwardly collapsible C-ring 34 will shift inwardly out of engagement with the intermediate mandrel 26 and out of engagement with the abutting ring 32. Abutting ring 32 will then shift downward releasing the comprehessive force on packing element 30 for retraction. The abutting ring is then caught by a suitable obstruction, such as coupling 38, as shown in FIG. 2B, or by a pickup ring 40 shown in the configuration of FIG. 1D. Retraction of the packing element will also permit the lower expander cone to shift downwardly thus releasing the wedging constraint along the lower edge of anchoring slip 20. Upper expander cone 16 can also be axially shifted relative to the released anchoring slip to permit disengagement of the anchoring slip from the casing so that the packer can be retrieved.

The wireline setting subassembly 300 shown in FIG. 3 also employs relative axial movement between the upper cone 16 and the remainder of the packer subassembly to radially expand and set the slip 20 and packing element 30. A typical wireline unit is attached to threads 308*d* on the wireline setting subassembly 300. Tension applied to a wireline shifts the upper sleeve 308 upward relative to the lower sleeve 318. Thus, compression is applied through threads 318*a* to the crossover sub 10 and ultimately to the upper cone 16 while tension is applied to the mandrel 6. Relative upward movement of mandrel 6 transmits a axially compressive load to the packing element 30 and shifts upper cone 16 relative to lower cone 22, thus expanding the slips and effecting the anchored engagement with the outer conduit or casing.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirt of the described invention.

What is claimed and desired to be secured by Letters Patent is:

1. In a packer apparatus for use in a subterranean well having a casing, said packer comprising: annular radially expandable, axially compressible packing element means; radially expandable anchoring slip means for securing the packer apparatus in the casing; first and second relatively axially shiftable expander members engageable with the slip means to radially expand the slip means to engage the casing; first and second abutment means engageable with the packing element means, the first and second abutment means being relatively axially shiftable to expand the packing element means to engage the casing; an inner mandrel extending through the slip means, the expander members and the packing element means, and having a seal bore surface therein; an intermediate mandrel encircling the inner mandrel and extending through the slip means, the expander members and the packing element means, the first expander member being moveable relative to the intermediate mandrel; and locking means between the intermediate mandrel and the first expander member permitting relative movement therebetween in one direction only; the improvement comprising: first disengageable means for securing the inner mandrel and the intermediate mandrel against relative axial movement therebetween during radial expansion of the packing element means and the slip means, release of the first disengageable means with the packing element means and slip means expanded permitting relative axial movement between the inner and intermediate mandrels; second disengageable means securing the intermediate mandrel to the second abutment means, the second disengageable means being shiftable to release the second abutment means from the intermediate mandrel upon relative axial movement between the inner mandrel and intermediate mandrel; a setting subassembly comprising inner and outer axially telescoping members, the inner telescoping member being attachable to the inner mandrel and the outer telescoping member being engageable with the first expander member for imparting relative movement between the first expander and the inner mandrel in response to a force applied to the setting subassembly; and a tubular member connectable and disconnectable to the inner telescoping member and having seals on the exterior thereof, the tubular member being shiftable in the inner mandrel with the seals engaging the seal bore surface thereon, whereby the packer apparatus may be set within a well to seal the annulus between the tubular member and the casing.

2. In the apparatus of claim 1, wherein the setting subassembly comprises means for imparting axial movement between the inner and outer telescoping members in response to manipulation of a wireline extending through the tubing from the setting subassembly.

3. In the apparatus of claim 1, wherein the setting subassembly comprises means for imparting axial movement between the inner and outer telescoping members in response to manipulation of a tubing string extending from the packer apparatus to the surface of the subterranean well.

4. In the apparatus of claim 3, wherein the setting assembly comprises means for imparting axial movement between the inner and outer telescoping members in response to rotation of the tubing extending from the packer apparatus to the surface of the subterranean well.

5. In the apparatus of claim 4, further comprising a releasable connection between the inner and outer telescoping members preventing relative axial movement therebetween during initial rotation of the tubing, the inner and outer telescoping members being released for relative axial movement after rotation of the tubing through a prescribed number of turns.

6. In the apparatus of claim 4, further comprising drag means for engaging the casing, the drag means remaining stationary during rotation of the tubing string when the releasable connection prevents relative axial movement between the inner and outer telescoping members, the releasable connection means comprising threaded means attached to the drag means.

7. In the apparatus of claim 1, wherein the first disengageable means comprises a shearable member.

8. In the apparatus of claim 1, wherein the second disengageable means comprises a radially biased member.

9. In the apparatus of claim 8, wherein the radially biased member comprises a resilient ring.

10. In the apparatus of claim 9, wherein the inner mandrel has an exterior recessed surface and an adjacent relatively thicker exterior section, the thicker exterior section engaging the resilient ring holding the resilient ring in engagement with the intermediate mandrel and the second abutment means when the first disengageable member prevents relative movement between the inner mandrel and intermediate mandrel, the resilient ring being retractable into the exterior recessed surface upon relative movement between the inner mandrel and the intermediate mandrel, the second abutment member being disengaged from the intermediate mandrel upon retraction of the resilient ring.

11. In the apparatus of claim 1, wherein the slip means and packing element means are expanded upon application of tensile force to the inner mandrel and the first and second disengageable means are released upon further application of tensile force to the inner mandrel.

12. In the apparatus of claim 1 wherein the setting subassembly is attachable only to the inner mandrel and the first expander.

* * * * *